US010854366B2

(12) United States Patent
Lee

(10) Patent No.: US 10,854,366 B2
(45) Date of Patent: Dec. 1, 2020

(54) MAGNETIC ASSEMBLY STRUCTURE AND ASSEMBLING/DISASSEMBLING METHOD USING THE MAGNETIC ASSEMBLY STRUCTURE

(71) Applicant: TAIWAN OASIS TECHNOLOGY CO., LTD., New Taipei (TW)

(72) Inventor: Wei-Long Lee, New Taipei (TW)

(73) Assignee: TAIWAN OASIS TECHNOLOGY CO., LTD., New Taipei (TW)

( * ) Notice: Subject to any disclaimer, the term of this patent is extended or adjusted under 35 U.S.C. 154(b) by 158 days.

(21) Appl. No.: 16/153,945

(22) Filed: Oct. 8, 2018

(65) Prior Publication Data

US 2020/0111592 A1 Apr. 9, 2020

(51) Int. Cl.

| | |
|---|---|
| ***H01F 1/00*** | (2006.01) |
| ***H01F 7/02*** | (2006.01) |
| ***H01F 7/08*** | (2006.01) |

(52) U.S. Cl.

CPC ..... *H01F 7/0263* (2013.01); *H01F 7/021* (2013.01); *H01F 7/081* (2013.01)

(58) Field of Classification Search

CPC ..... H01F 7/0263; H01F 7/081; H01F 7/021

USPC ..... 335/209

See application file for complete search history.

(56) References Cited

U.S. PATENT DOCUMENTS

| | | | | |
|---|---|---|---|---|
| 3,898,599 | A * | 8/1975 | Reid | H01F 13/003 335/302 |
| 2005/0057101 | A1* | 3/2005 | Nakagawa | H01F 7/1615 310/12.24 |
| 2007/0171009 | A1* | 7/2007 | Bouchard | H01F 7/14 335/14 |
| 2008/0180201 | A1* | 7/2008 | Sato | H04R 9/025 335/278 |

* cited by examiner

*Primary Examiner* — Shawki S Ismail
*Assistant Examiner* — Lisa N Homza
(74) *Attorney, Agent, or Firm* — Demian K. Jackson; Jackson IPG PLLC

(57) ABSTRACT

A magnetic assembly structure has a main body and an inserting component. A first receiving slot of the main body receives a first magnetic component, and a second receiving slot of the main body penetrates a main body surface to form a main body opening on the main body surface. An engagement slot of the main body is disposed between the first receiving slot and the second receiving slot, communicated with the second receiving slot, and has a contacting surface being away from the main body surface with a distance. The receiving slot of the inserting component receives a second magnetic component. The inserting component is inserted into the second receiving slot via the main body opening, and the second magnetic component moves into the engagement slot. The magnetic assembly is assembled with a less force, has higher safety, and is hard to be disassembled without allowance or explanations.

11 Claims, 19 Drawing Sheets

MAGNETIC ASSEMBLY STRUCTURE AND ASSEMBLING/DISASSEMBLING METHOD USING THE MAGNETIC ASSEMBLY STRUCTURE

BACKGROUND

1. Technical Field

The present disclosure relates to a magnetic assembly structure and an assembling/disassembling method using the magnetic assembly structure, and in particular, to a magnetic assembly structure and an assembling/disassembling method using the magnetic assembly structure, which utilize an attracting or repulsive force of two magnetic components to make a main body and an inserting component automatically engaged to each other.

2. Description of Related Art

Generally, one manner to assemble two main bodies to form an object can be to fix the two main bodies by screwing or nailing. For example, an intermediate object can contact two rod parts, and a screw or nail penetrates the intermediate object to lock or fix the two rod parts. For example, one end of a rod part has a receiving room for receiving one end of another rod part, and a screw or nail penetrates the intermediate object to lock or fix the two rod parts. However, these manners may make the joint surface of the two main bodies protruded and non-flat, and thus a user using such object may be damaged when the user is hook by the protruded joint surface.

Additionally, another manner for fixing the two main body is to design a male thread and a female thread respectively on the two main bodies, and thus via the female and male threads, the two main bodies are assembled to form an object. For example, one end of an rod part has an opening, an inner wall of a receiving room of the opening has a female thread, another rod part has a protruding portion, and an outer wall of the protruding portion has a male thread, such that the two rod parts can be fixed to each other via the female and male threads. The manner can efficiently resist again a vertical disassembling operation, but cannot further resist against a rotational disassembling operation.

In the conventional manners, regardless of whether the nail, screw or thread is used to fix or lock the two main bodies, these conventional manners requires the user to provide her/his force, and cannot prevent the malicious person from disassembling the object without allowance or explanations. Even, the manner which utilizes the nail or screw to fix or lock the two main bodies makes the joint surface of the two main bodies non-flat, and it is easy to damage the user due to the non-flat surface. Therefore, the conventional manners have technical problems of consuming force for assembling, easily disassembling by the malicious person without allowance or explanations, and less safety.

Thus, how to utilize novel hardware structure design to implement the assembly object which can be assembled with a less force, increase safety and be hardly disassembled without allowance or explanations, is still an issue which the related industrial developer and researcher dedicate to overcome and solve.

SUMMARY

A main objective of the present disclosure is to provide a magnetic assembly structure which utilizes an attracting or repulsive force of two magnetic components to automatically engage a main body and an inserting component, wherein the magnetic assembly structure can simultaneously resist against the vertical and rotational disassembling operations, and the joint surface is flat to prevent the user from being hook by the joint surface to avoid any damage. Even, the assembling manner cannot be known from the appearance of the joint surface, and thus it can prevent the malicious person from disassembling magnetic assembly structure without allowance or explanations. Additionally the magnetic assembly structure can be applied in the furniture, daily necessity and electronic equipment, and the present disclosure is not limited thereto, thus having a wide application scope.

According to an objective of the present disclosure, an embodiment of the present disclosure provides a magnetic assembly structure comprising a main body and an inserting component. The main body has a first receiving slot, a second receiving slot, an engagement slot and a main body surface, wherein the first receiving slot receives a first magnetic component, the second receiving slot penetrates the main body surface to form a main body opening on the main body surface, the engagement slot is disposed between the first receiving slot and the second receiving slot, or alternatively, the second receiving slot is disposed between the first receiving slot and the engagement slot, and the engagement slot is communicated with the second receiving slot and has a contacting surface which is away from the main body surface with a distance. The inserting component has a receiving slot of the inserting component, and the receiving slot of the inserting component receives a second magnetic component. The inserting component is inserted into the second receiving slot via the main body opening, and the second magnetic component moves into the engagement slot.

Regarding the above magnetic assembly structure, wherein a portion of the second magnetic component moves into the engagement slot, and other portion of the second magnetic component stays in the second receiving slot, so as to prevent the inserting component from sliding out from the second receiving slot.

Regarding the above magnetic assembly structure, wherein the second magnetic component contacts the contacting surface, so as to prevent the inserting component from sliding out from the second receiving slot.

Regarding the above magnetic assembly structure, wherein the second magnetic component moves into the engagement slot via a magnetic force induced by the second magnetic component and first magnetic component.

Regarding the above magnetic assembly structure, wherein the engagement slot is disposed between the first receiving slot and the second receiving slot, and the second magnetic component moves into the engagement slot via a magnetic attracting force induced by the second magnetic component and first magnetic component.

Regarding the above magnetic assembly structure, wherein the engagement slot is disposed between the first receiving slot and the second receiving slot, the first magnetic component is a magnetic conduction component and the second magnetic component is a magnet component, or the first magnetic component and the second magnetic component are two magnet components and two opposite magnet poles of the first magnetic component and the second magnetic component are different.

Regarding the above magnetic assembly structure, wherein the main body extends along a first direction, the inserting component extends along a second direction being vertical to the first direction, and a width of the inserting component is less than a length of the main body.

Regarding the above magnetic assembly structure, wherein the second receiving slot is disposed between the first receiving slot and the engagement slot, and the second magnetic component moves into the engagement slot via a magnetic repulsive force induced by the second magnetic component and first magnetic component.

Regarding the above magnetic assembly structure, wherein the second receiving slot is disposed between the first receiving slot and the engagement slot, and the first magnetic component and the second magnetic component are two magnet components and two opposite magnet poles of the first magnetic component and the second magnetic component are identical.

Regarding the above magnetic assembly structure, wherein the main body and the inserting component extend along a same direction, and a back end of the inserting component is a bulk portion, a width and a thickness of a front end of the inserting component are respectively less than a width and a thickness of the back end of the inserting component, and the width and the thickness of a back end of the inserting component are respectively the same as a width and a thickness of the main body.

Regarding the above magnetic assembly structure, wherein the engagement slot is communicated with the second receiving slot via a communicating opening, and the second magnetic component moves into the engagement slot via the communicating opening.

Regarding the above magnetic assembly structure, wherein the inserting component has an inserting component surface, the receiving slot of the inserting component penetrates the inserting component surface to form an inserting component opening on the inserting component surface, and the second magnetic component sequentially passes the inserting component opening and the communicating opening to move into the engagement slot.

Regarding the above magnetic assembly structure, wherein the first receiving slot penetrates the main body surface to form a first receiving slot opening on the main body surface, and the first magnetic component is disposed in the first receiving slot via the first receiving slot opening.

According to an objective of the present disclosure, an embodiment of the present disclosure provides an assembling/disassembling method using the above magnetic assembly structure. When assembling, the inserting component is inserted into the second receiving slot via the main body opening. When disassembling, an external magnetic component is provided and a magnetic force of the external magnetic component and the second magnetic component is utilized to move a portion of the second magnetic component, which is located in the engagement slot, to the second receiving slot from the engagement slot, and next, the inserting component is taken out from the second receiving slot via the main body opening.

According to an objective of the present disclosure, an embodiment of the present disclosure provides a magnetic assembly structure comprising a main body, a first inserting component and a second inserting component. The main body has a first receiving slot, a second receiving slot, a first engagement slot, a second engagement slot, a first main body surface and a second main body surface, wherein the first main body surface is disposed corresponding to the second main body surface, the first receiving slot penetrates first main body surface to form a first main body opening on the first main body surface, the second receiving slot penetrates the second main body surface to form a second main body opening on the second main body surface, the first engagement slot and the second engagement slot are respectively communicated with the first receiving slot and the second receiving slot, and respectively have a first contacting surface being away from the first main body surface with a first distance and a second contacting surface being away from the second main body surface with a second distance, and the first engagement slot and the second engagement slot are disposed between the first receiving slot and the second receiving slot, or alternatively, the first receiving slot and the second receiving slot are disposed between the first engagement slot and the second engagement slot. The first inserting component has a first receiving slot of the first inserting component, and the first receiving slot of the first inserting component receives a first magnetic component. The second inserting component has a second receiving slot of the second inserting component, and the second receiving slot of the second inserting component receives a second magnetic component. The first inserting component and the second inserting component are respectively inserted into the first receiving slot and the second receiving slot via the first main body opening and the second main body opening, and the first magnetic component and the second magnetic component respectively move into the first engagement slot and the second engagement slot.

Regarding the above magnetic assembly structure, wherein a portion of the first magnetic component and a portion of the second magnetic component respectively move into the first engagement slot and the second engagement slot, and other portion of the first magnetic component and other portion of the second magnetic component respectively stay in the first receiving slot and the second receiving slot, so as to prevent the first inserting component and the second inserting component respectively from sliding out from the first receiving slot and the second receiving slot.

Regarding the above magnetic assembly structure, wherein the first magnetic component and the second magnetic component respectively contact the first contacting surface and the second contacting surface, so as to prevent the first inserting component and the second inserting component respectively from sliding out from the first receiving slot and the second receiving slot.

Regarding the above magnetic assembly structure, wherein he first magnetic component and the second magnetic component respectively move into the first engagement slot and the second engagement slot via a magnetic force induced by the second magnetic component and first magnetic component.

Regarding the above magnetic assembly structure, wherein the first engagement slot and the second engagement slot are disposed between the first receiving slot and the second receiving slot, and the first magnetic component and the second magnetic component respectively move into the first engagement slot and the second engagement slot via a magnetic attracting force induced by the second magnetic component and first magnetic component.

Regarding the above magnetic assembly structure, wherein the first engagement slot and the second engagement slot are disposed between the first receiving slot and the second receiving slot, and the first magnetic component and the second magnetic component are two magnet components and two opposite magnet poles of the first magnetic component and the second magnetic component are different.

Regarding the above magnetic assembly structure, wherein the first receiving slot and the second receiving slot are disposed between the first engagement slot and the second engagement slot, and the first magnetic component and the second magnetic component respectively move into the first engagement slot and the second engagement slot via a magnetic repulsive force induced by the second magnetic component and first magnetic component.

Regarding the above magnetic assembly structure, wherein the first receiving slot and the second receiving slot are disposed between the first engagement slot and the second engagement slot, and the first magnetic component and the second magnetic component are two magnet components and two opposite magnet poles of the first magnetic component and the second magnetic component are identical.

Regarding the above magnetic assembly structure, wherein the main body extends along a first direction, the first inserting component and the second inserting component extend along a second direction being vertical to the first direction, back ends of the first inserting component and the second inserting component are respectively a first bulk portion and a second bulk portion, widths and thicknesses of front ends of the first inserting component and the second inserting component are respectively less than widths and thicknesses of the back ends of the first inserting component and the second inserting component, and the widths and the thicknesses of the back ends of the first inserting component and the second inserting component are respectively the same as a length and a thickness of the main body.

Regarding the above magnetic assembly structure, wherein the first engagement slot and the second engagement slot are respectively communicated with the first receiving slot and the second receiving slot via a first communicating opening and a second communicating opening, and the first magnetic component and the second magnetic component respectively move into the first engagement slot and the second engagement slot via the first communicating opening and the second communicating opening.

Regarding the above magnetic assembly structure, wherein the first inserting component has a first inserting component surface, the first receiving slot of the first inserting component penetrates the first inserting component surface to form a first inserting component opening on the first inserting component surface, and the first magnetic component sequentially passes the first inserting component opening and the first communicating opening to move into the first engagement slot; the second inserting component has a second inserting component surface, the second receiving slot of the second inserting component penetrates the second inserting component surface to form a second inserting component opening on the second inserting component surface, and the second magnetic component sequentially passes the second inserting component opening and the second communicating opening to move into the second engagement slot.

According to an objective of the present disclosure, an embodiment of the present disclosure provides an assembling/disassembling method using the above magnetic assembly structure. When assembling, the first inserting component and the second inserting component respectively are inserted into the first receiving slot and the second receiving slot via the first main body opening and the second main body opening. When disassembling, a first external magnetic component and a second external magnetic component are provided, a magnetic force of the first external magnetic component and the first magnetic component is utilized to move a portion of the first magnetic component, which is located in the first engagement slot, to the first receiving slot from the first engagement slot, a magnetic force of the second external magnetic component and the second magnetic component is utilized to move a portion of the first second component, which is located in the second engagement slot, to the second receiving slot from the second engagement slot, and next, the first inserting component and the second inserting component are respectively taken out from the first receiving slot and the second receiving slot via the first main body opening and the second main body opening.

To sum up, the magnetic assembly structure mainly utilizes the magnetic force of the magnetic components to assemble the main body and the inserting component, and thus the implemented assembly object is assembled with less force, increases the safety, and can prevent the disassembling without allowance or explanations.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

To understand the technical features, content and advantages of the present disclosure and its efficacy, the present disclosure will be described in detail with reference to the accompanying drawings. The drawings are for illustrative and auxiliary purposes only and may not necessarily be the true scale and precise configuration of the present disclosure. Therefore, the scope of the present disclosure should not be limited to the scale and configuration of the attached drawings.

Figure 1:
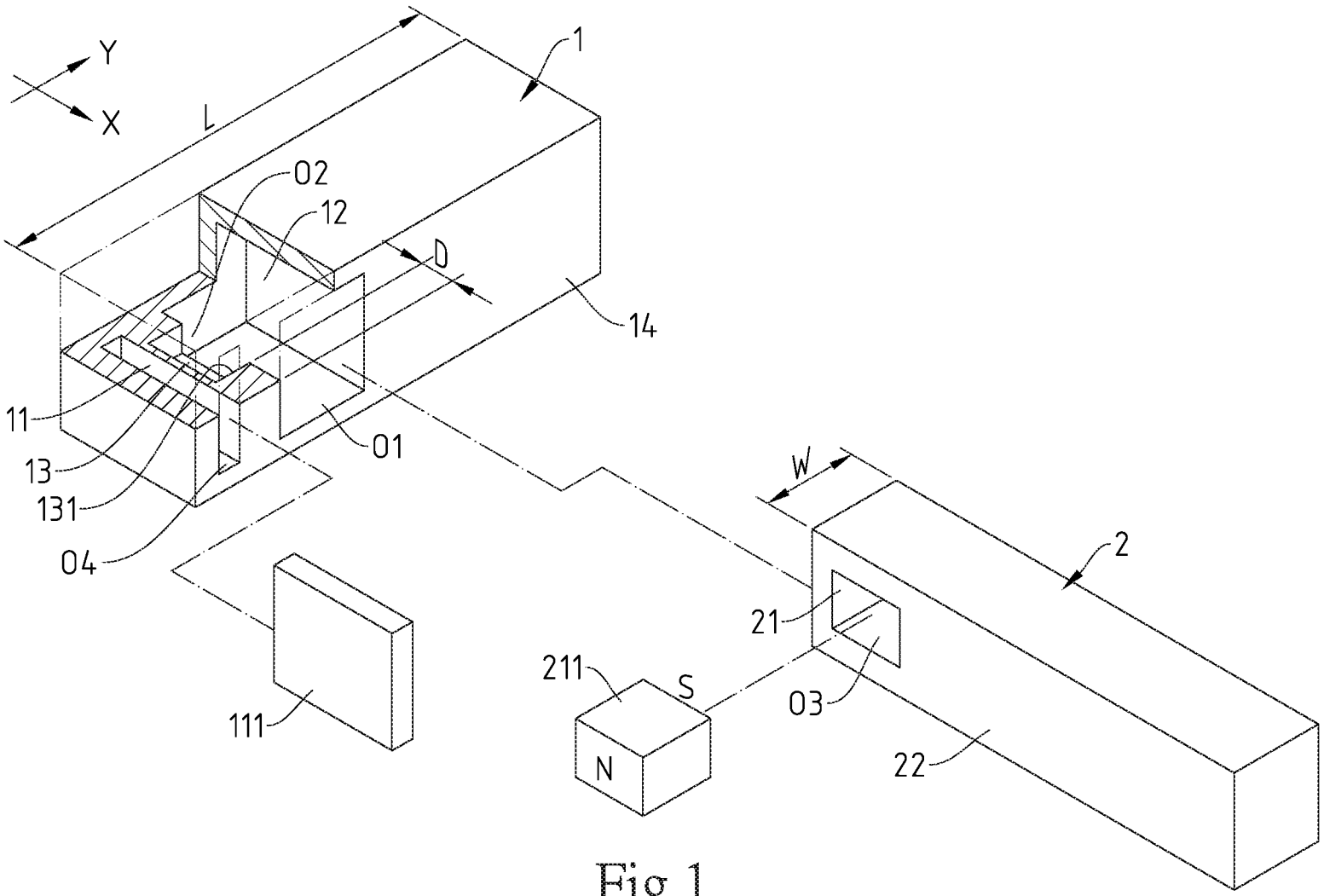
FIG. 1 is a three dimensional explosive diagram of a magnetic assembly structure provided by a first embodiment of the present disclosure.
Figure 2:
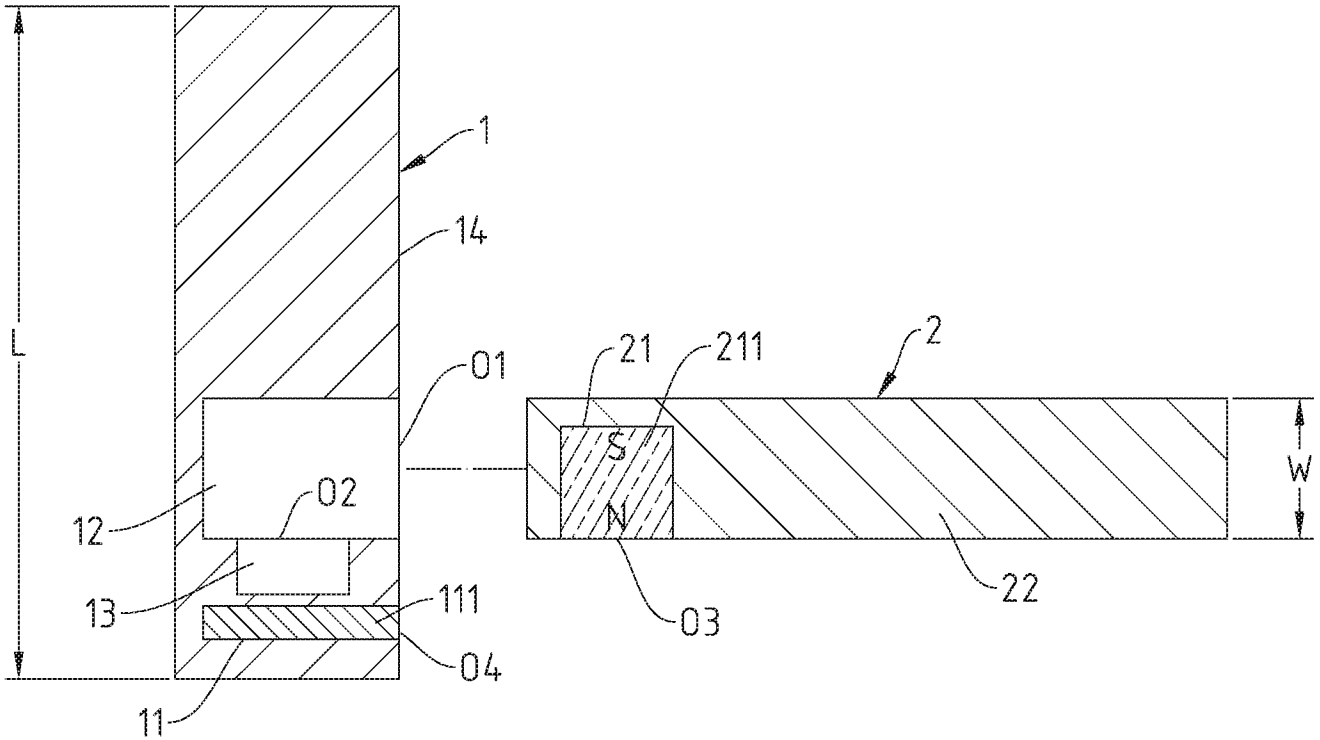
FIG. 2 is a top view of a magnetic assembly structure provided by a first embodiment of the present disclosure.
Figure 3:
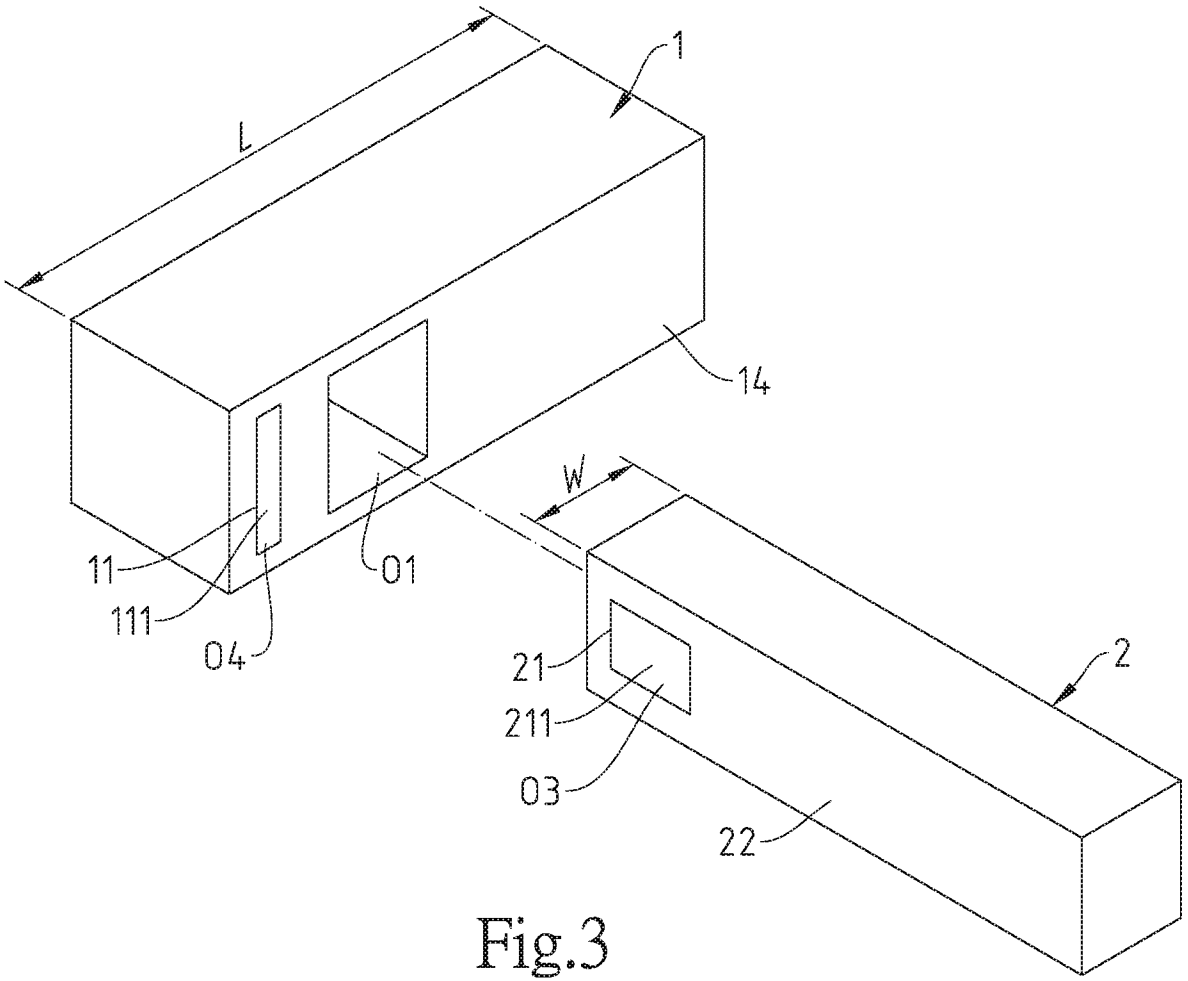
FIG. 3 is a three dimensional diagram of a disassembled magnetic assembly structure provided by a first embodiment of the present disclosure.

FIG. 1 through FIG. 5 are used to illustrate a whole structure and an assembling/disassembling manner of a magnetic assembly structure provided by a first embodiment of the present disclosure. As shown in FIG. 1 through FIG. 3, the magnetic assembly structure comprises a main body 1 and an inserting component 2. The main body 1 extends along a first direction X, an inserting component 2 extends along a second direction Y being vertical to the first direction X, and a thickness W of an inserting component 2 is less than a length L of the main body 1. The inserting component 2 can be inserted into the main body 1, the inserting component 2 and the main body 1 can be engaged to each other via a magnetic force, and thus the magnetic assembly structure can prevent a malicious person from using a vertical and horizontal disassembling operating to disassemble magnetic assembly structure without allowance or explanations. The above magnetic assembly structure can applied in the furniture, daily necessity and electronic equipment, and the present disclosure is not limited thereto, thus having a wide application scope. For example, the main body 1 can be the table main body and the inserting component 2 can be the table leg.

The main body 1 has a first receiving slot 11, a second receiving slot 12, an engagement slot 13 and a main body surface 14. The first receiving slot 11 penetrates the main body surface 14 to form a first receiving slot opening O4 on the main body surface 14, and the first magnetic component 111 can be disposed in the first receiving slot 11 via the first receiving slot opening O4. The first magnetic component 111 can be a magnetic conduction component, such as an iron sheet or other magnetic conduction sheet. The second receiving slot 12 penetrates the main body surface 14 to form the main body opening O1 on the main body surface 14. The engagement slot 13 is disposed between the first receiving slot 11 and the second receiving slot 12, and is communicated with the second receiving slot 12 via the communicating opening O2. In addition, the engagement slot 13 further has contacting surface 131 being away from the main body surface 14 with a distance D.

The inserting component 2 has a receiving slot of the inserting component 21 and an inserting component surface 22, the receiving slot of the inserting component 21 penetrates the inserting component surface 22 to form the inserting component opening O3 on the inserting component surface 22, and the second magnetic component 211 is disposed in the receiving slot of the inserting component 21 via the inserting component opening O3. The second magnetic component 211 is a magnet component, a magnet pole of the second magnetic component 211, which faces the first magnetic component 111, is an N pole, and other magnet pole of the second magnetic component 211, which faces an inner wall of the receiving slot of the inserting component 21, is an S pole. In addition, in other embodiment, a magnet pole of the second magnetic component 211, which faces the first magnetic component 111, is an S pole, and other magnet pole of the second magnetic component 211, which faces an inner wall of the receiving slot of the inserting component 21, is an N pole.

Figure 4:
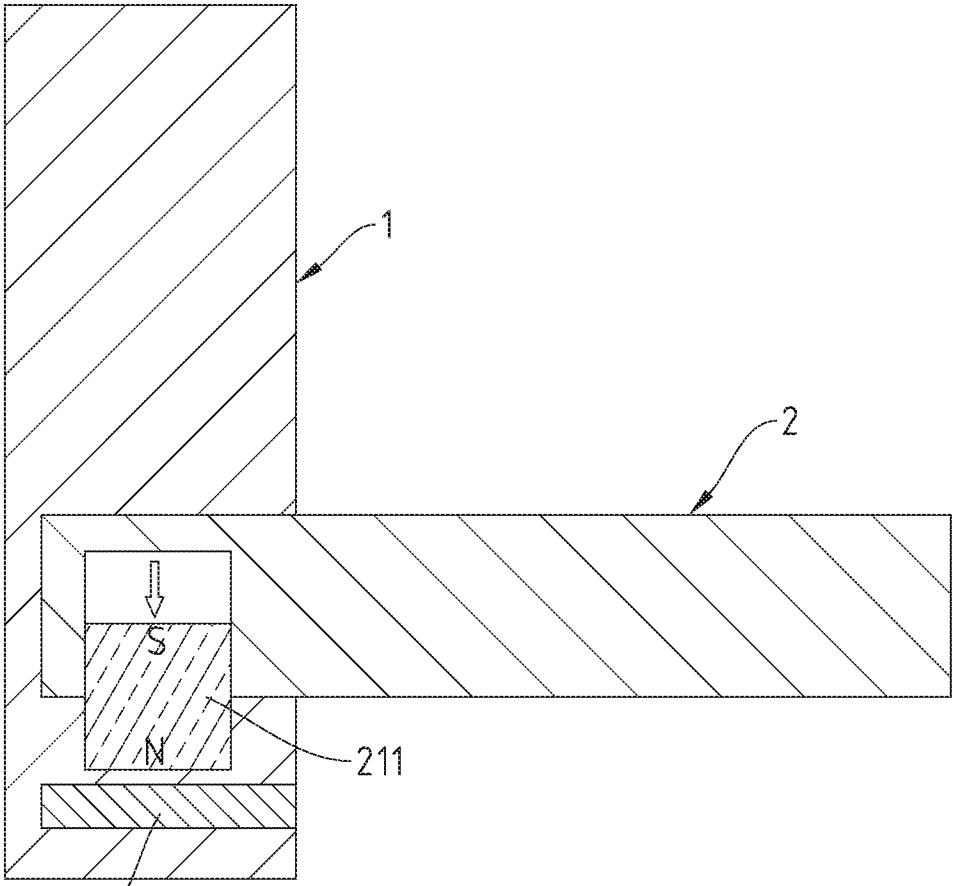
FIG. 4 is a top view of an assembled magnetic assembly structure provided by a first embodiment of the present disclosure.

As shown in FIG. 2 and FIG. 4 (refer to FIG. 4 mainly, and refer to FIG. 2 secondarily), when assembling, the user can inserts the inserting component 2 into the second receiving slot 12 via the main body opening O1. To put it concretely, the section area of the main body opening O1 is larger than or equal to the section area of the inserting component 2, which faces the main body opening O1, such that the inserting component 2 can be inserted into the second receiving slot 12 via the main body opening O1.

After the user inserts the inserting component 2 into the second receiving slot 12 via the main body opening O1, via a magnetic attracting force induced by the first magnetic component 111 and the second magnetic component 211, the second magnetic component 211 sequentially passes the inserting component opening O3 and the communicating opening O2 to move into the engagement slot 13, wherein a portion of the second magnetic component 211 moves into the engagement slot 13, other portion of the second magnetic component 211 stays in the second receiving slot 12, and thus the second magnetic component 211 contacts the contacting surface 131, so as to prevent the inserting component 2 from sliding out from the second receiving slot 12. Specifically, the section area of the communicating opening O2 is larger than or equal to the section area of the inserting component opening O3, such that the second magnetic component 211 can move into the engagement slot 13. Since the second magnetic component 211 moves into the engagement slot 13 due to the magnetic force, the fixing and screwing manners are not required, and the magnetic assembly structure has an advantage of assembling with a less force.

Figure 5:
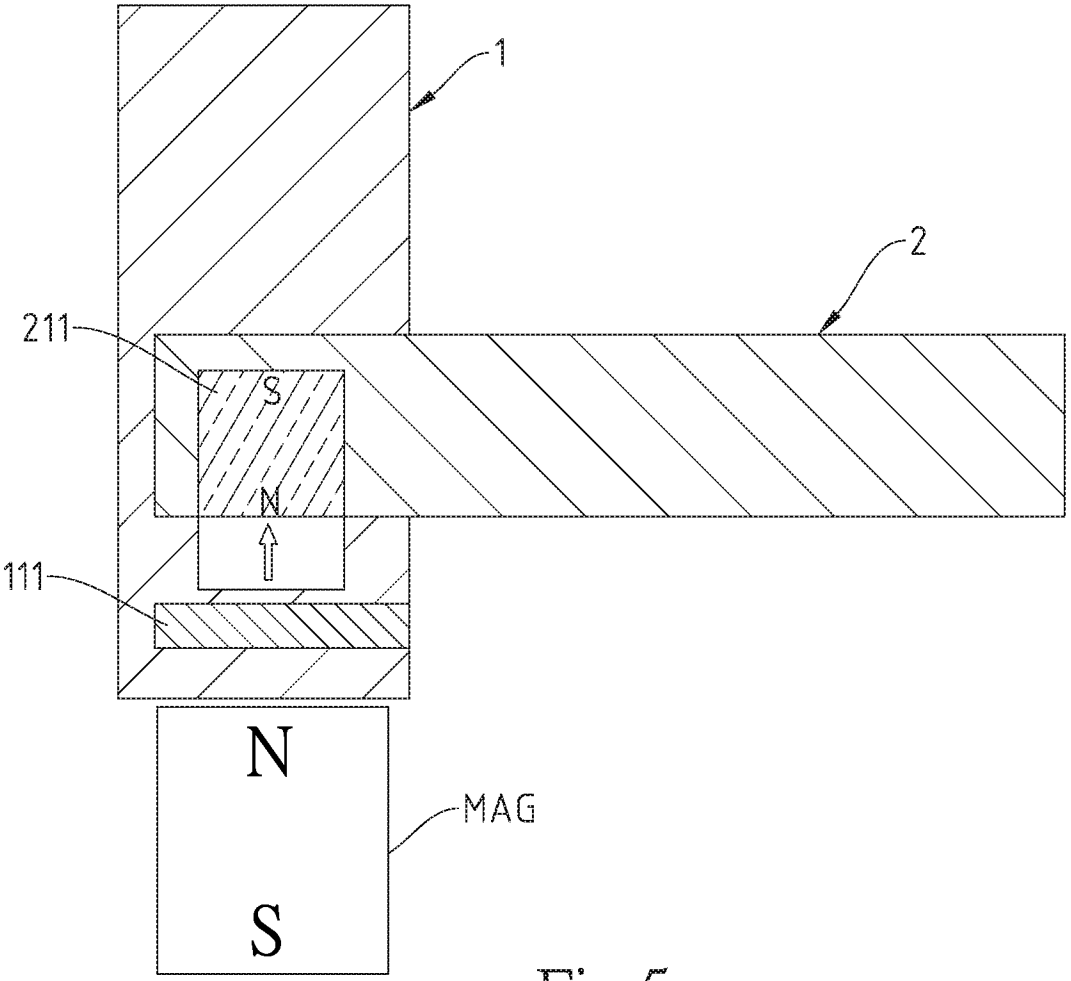
FIG. 5 is a top view of disassembling an assembled magnetic assembly structure provided by a first embodiment of the present disclosure.

As shown in FIG. 2 and FIG. 5 (refer to FIG. 5 mainly, and refer to FIG. 2 secondarily), when disassembling, a magnetic repulsive force of a provided external magnetic component MAG and the second magnetic component 211 (i.e. the N pole of the external magnetic component MAG faces the N pole of the second magnetic component 211) is utilized to make the portion of the second magnetic component 211, which is located in the engagement slot 13, move into the second receiving slot 12. Next, the user can take the inserting component 2 out from the second receiving slot 12 via the main body opening O1, so as to complete the disassembly.

Figure 6:
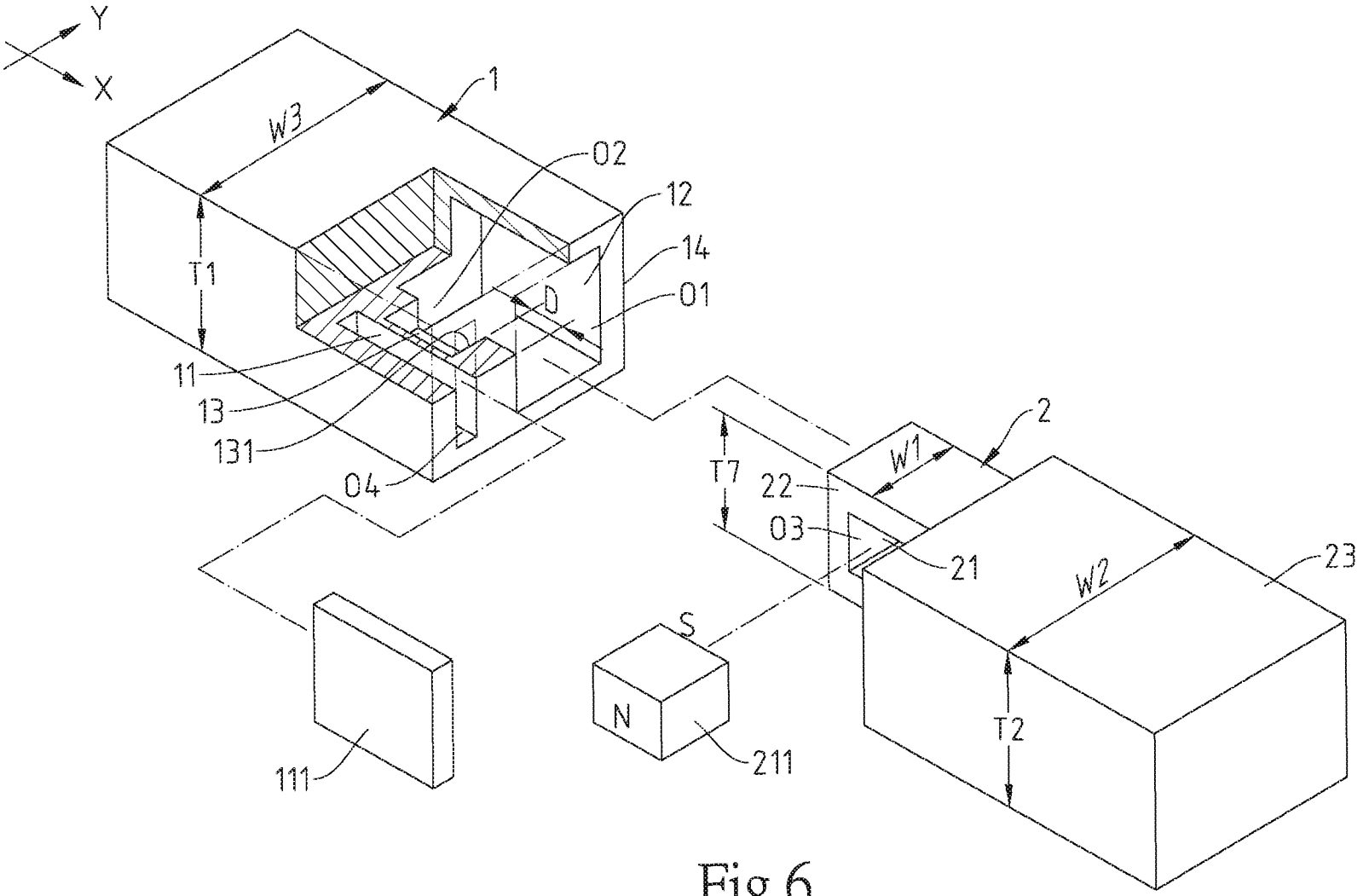
FIG. 6 is a three dimensional explosive diagram of a magnetic assembly structure provided by a second embodiment of the present disclosure.

FIG. 6 through FIG. 8B are used to illustrate a whole structure and an assembling/disassembling manner of a magnetic assembly structure provided by a second embodiment of the present disclosure. The differences between the second embodiment and the first embodiment are the relative dimensions and extending directions of the main body 1 and the inserting component 2 and that the back end of the inserting component 2 has a bulk portion 23. As shown in FIG. 6, the main body 1 and the inserting component 2 extend along the second direction Y, and the back end of the inserting component 2 is the bulk portion 23, wherein the width W1 and the thickness T7 of the front end of the inserting component 2 are respectively less than the width W2 and the thickness T2 of the back end of the inserting component 2, and the width W2 and the thickness T2 of the back end of the inserting component 2 are respectively equal to the width W3 and thickness T1 of the main body 1.

Figure 7A:
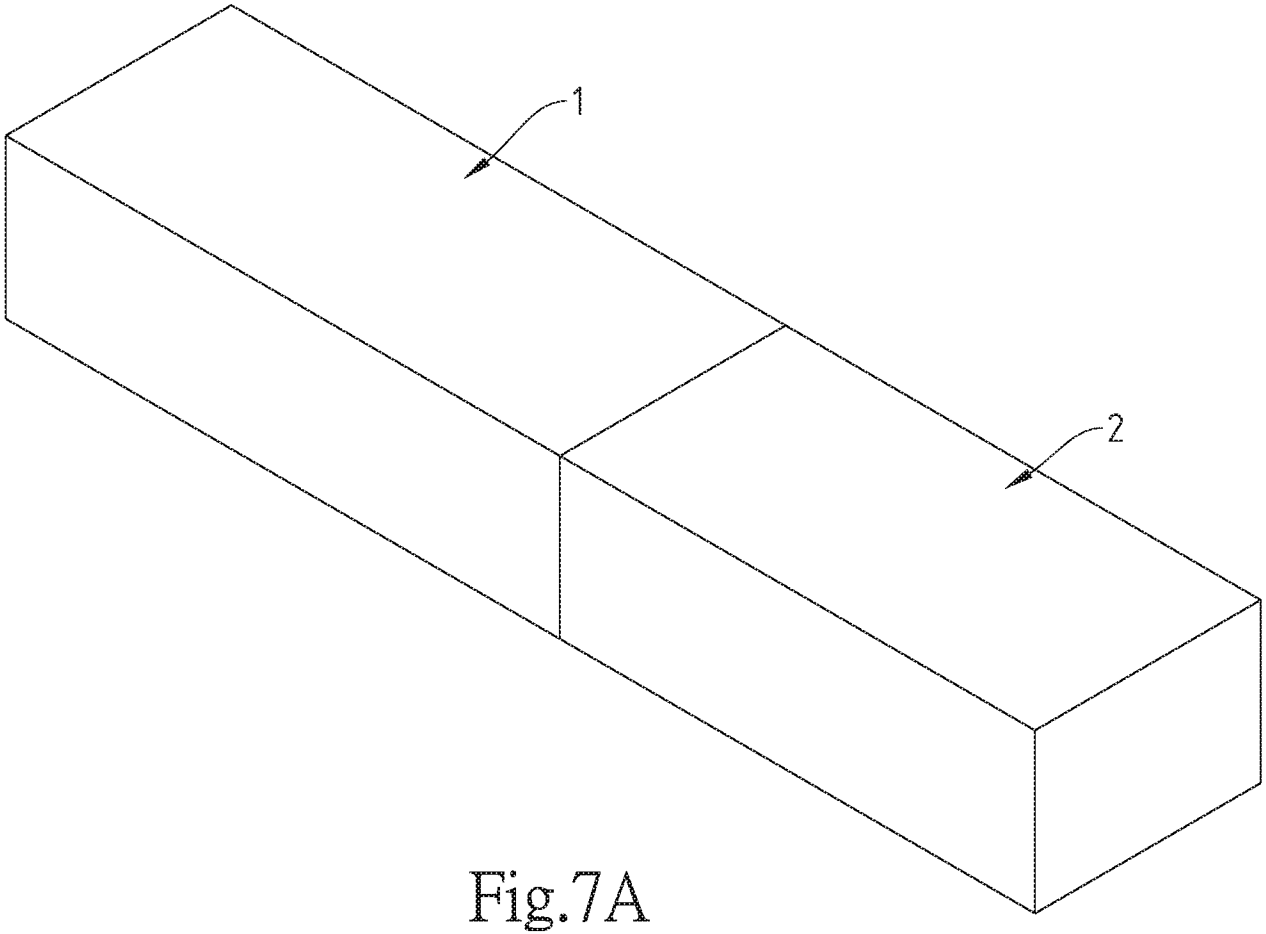
FIG. 7A is a three dimensional diagram of an assembled magnetic assembly structure provided by a second embodiment of the present disclosure.

In other words, the section area of the bulk portion 23 of the inserting component 2, which faces the second direction Y, is equal to the section area of the main body, which faces the second direction Y. Thus, as shown in FIG. 7, the assembled magnetic assembly structure is almost one part, the joint surface is almost flat, and merely a tiny thin line between the main body 1 and the inserting component 2 can be seen. In the second embodiment, the magnetic assembly structure can also be applied in the furniture, daily necessity and electronic equipment, and the present disclosure is not limited thereto, thus having a wide application scope. For example, the main body 1 can be the main table leg body, and the inserting component 2 can be the extension table leg part, so as to form a longer table leg. Since the assembled magnetic assembly structure has the almost flat joint surface, being not like the conventional assembly structure, the assembled magnetic assembly structure has no non-flat joint surfaces which may be hook by the user to cause the damage or danger, and the magnetic assembly structure in the second embodiment has the higher safety.

Figure 7B:
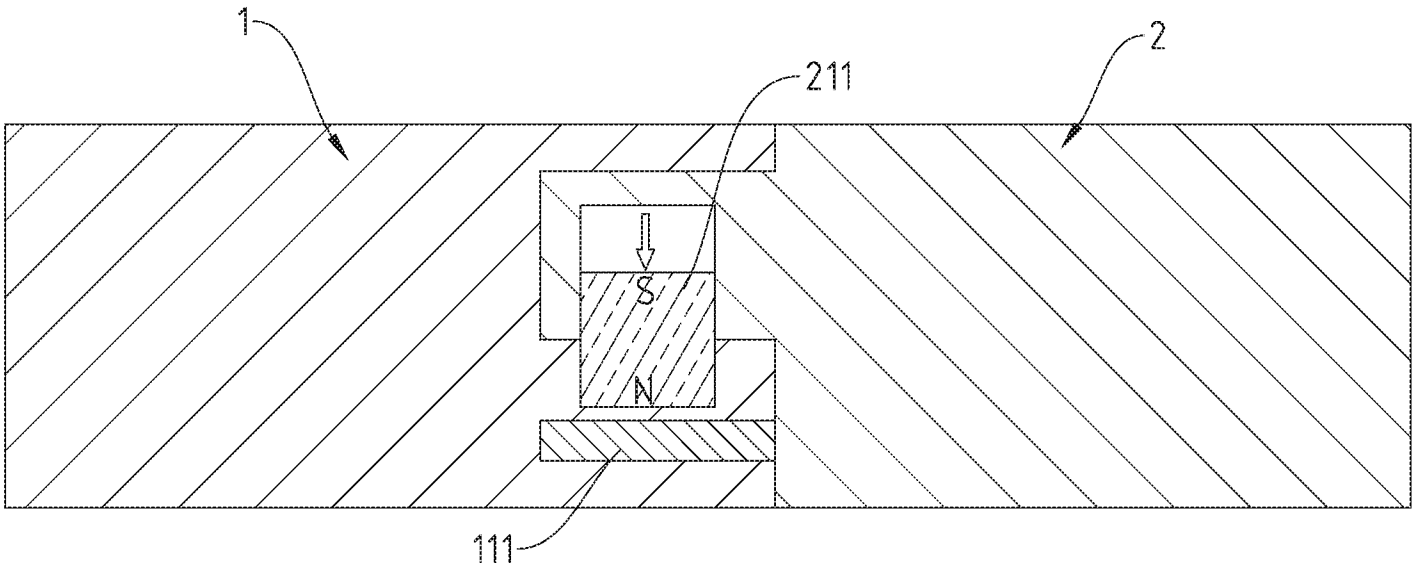
FIG. 7B is a top view of an assembled magnetic assembly structure provided by a second embodiment of the present disclosure.

The assembling manner of the magnetic assembly structure in the second embodiment is the same as that of the magnetic assembly structure in the first embodiment. As shown in FIG. 6 and FIG. 7B (refer to FIG. 7B mainly, and refer to FIG. 6 secondarily), when assembling, the user can insert the inserting component 2 into the second receiving slot 12 via the main body opening O1. After the user inserts the inserting component 2 into the second receiving slot 12 via the main body opening O1, via a magnetic attracting force induced by the first magnetic component 111 and the second magnetic component 211, the second magnetic component 211 sequentially passes the inserting component opening O3 and the communicating opening O2 to move into the engagement slot 13.

Figure 8A:
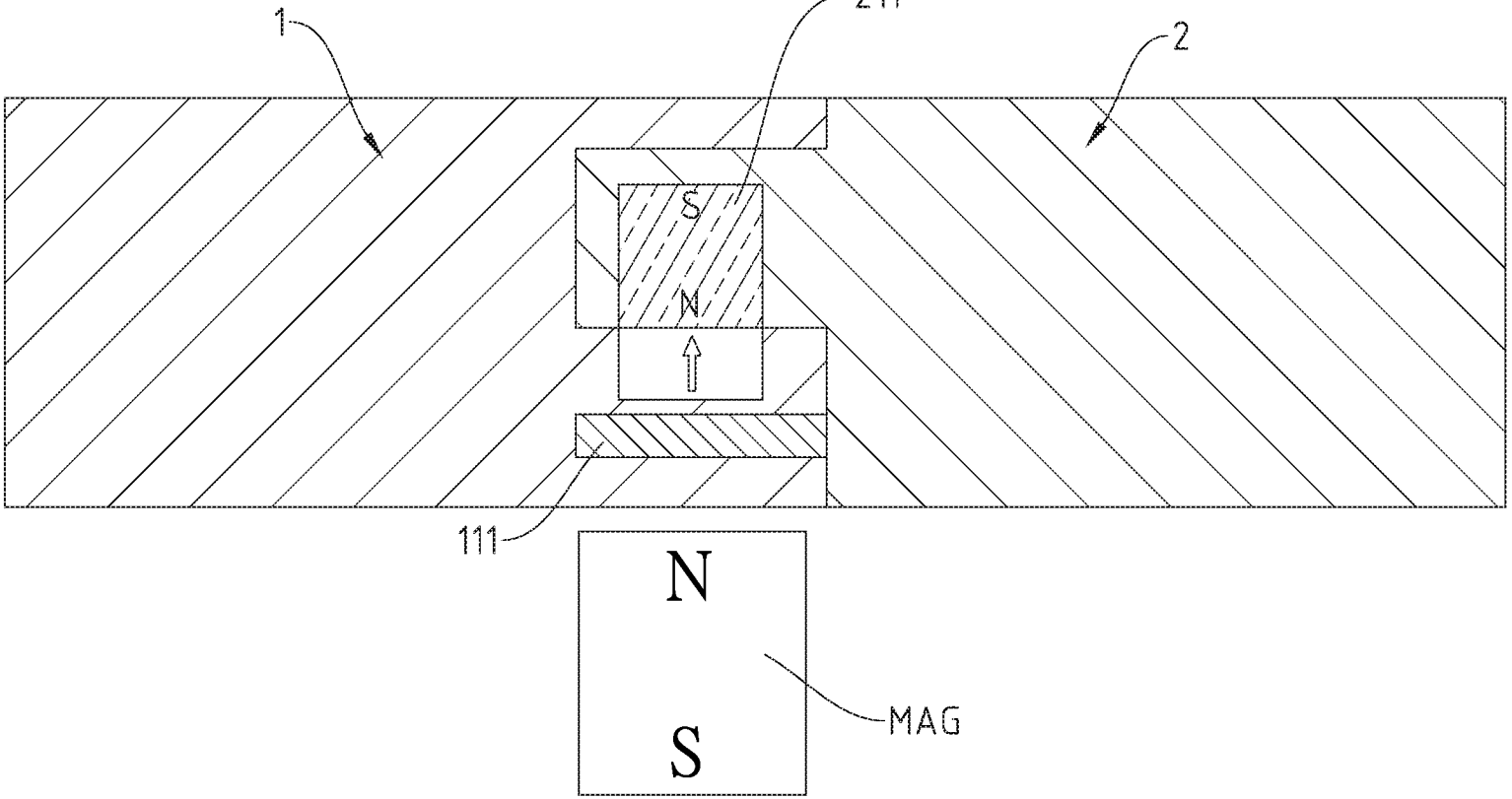
FIG. 8A is a top view of disassembling an assembled magnetic assembly structure provided by a second embodiment of the present disclosure.

The disassembling manner of the magnetic assembly structure in the second embodiment is the same as that of the magnetic assembly structure in the first embodiment. As shown in FIG. 8A and FIG. 6 (refer to FIG. 8A mainly, and refer to FIG. 6 secondarily), when disassembling, a magnetic repulsive force of a provided external magnetic component MAG and the second magnetic component 211 (i.e. the N pole of the external magnetic component MAG faces the N pole of the second magnetic component 211) is utilized to make the portion of the second magnetic component 211, which is located in the engagement slot 13, move into the second receiving slot 12. Next, the user can take the inserting component 2 out from the second receiving slot 12 via the main body opening O1, so as to complete the disassembly.

Figure 8B:
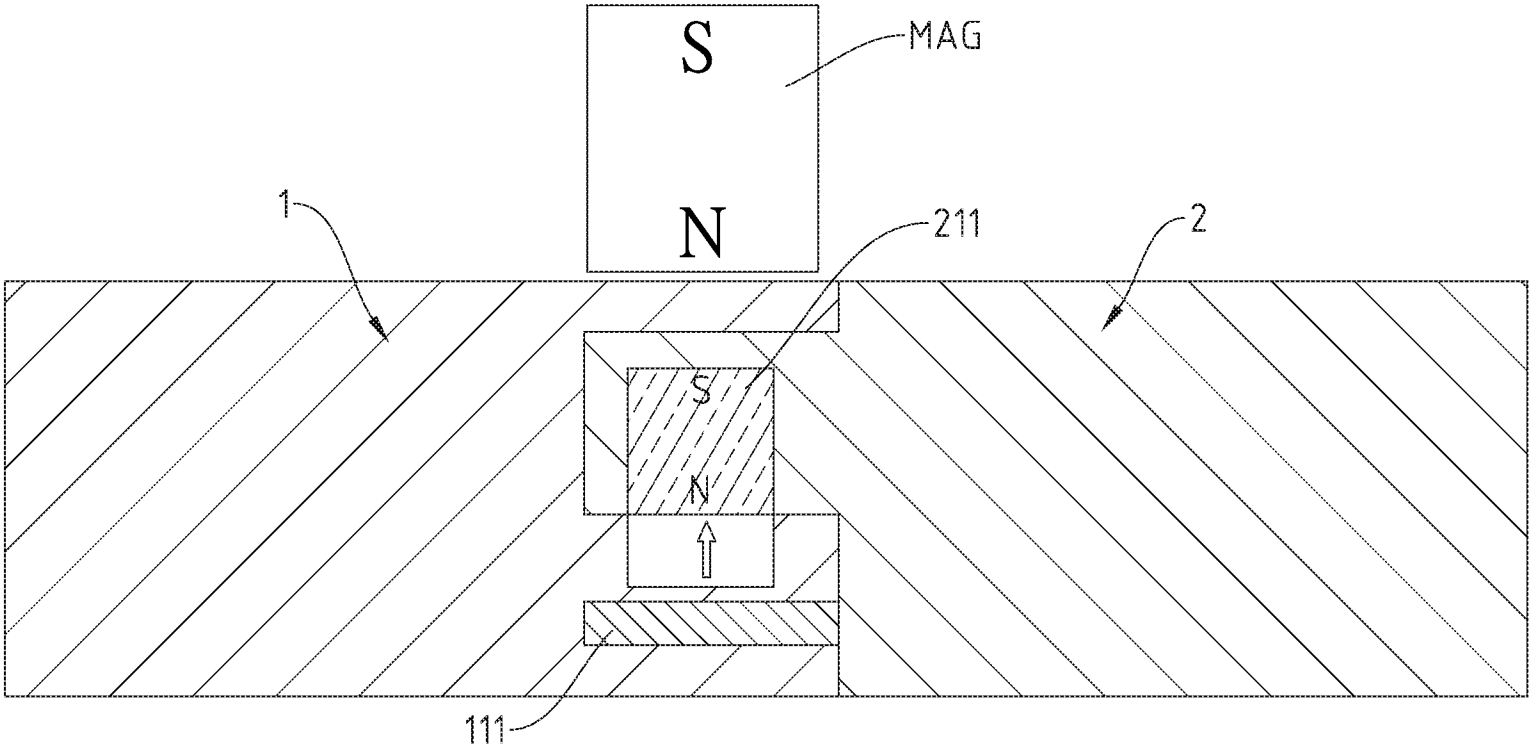
FIG. 8B is another top view of disassembling an assembled magnetic assembly structure provided by a second embodiment of the present disclosure.

In addition, another disassembling manner of the magnetic assembly structure in the second embodiment is disclosed as follows. As shown in FIG. 6 and FIG. 8B (refer to FIG. 8B mainly, and refer to FIG. 6 secondarily), when disassembling, a magnetic attracting force of a provided external magnetic component MAG and the second magnetic component 211 (i.e. the N pole of the external magnetic component MAG faces the S pole of the second magnetic component 211) is utilized to make the portion of the second magnetic component 211, which is located in the engagement slot 13, move into the second receiving slot 12. Next, the user can take the inserting component 2 out from the second receiving slot 12 via the main body opening O1, so as to complete the disassembly.

Figure 9A:
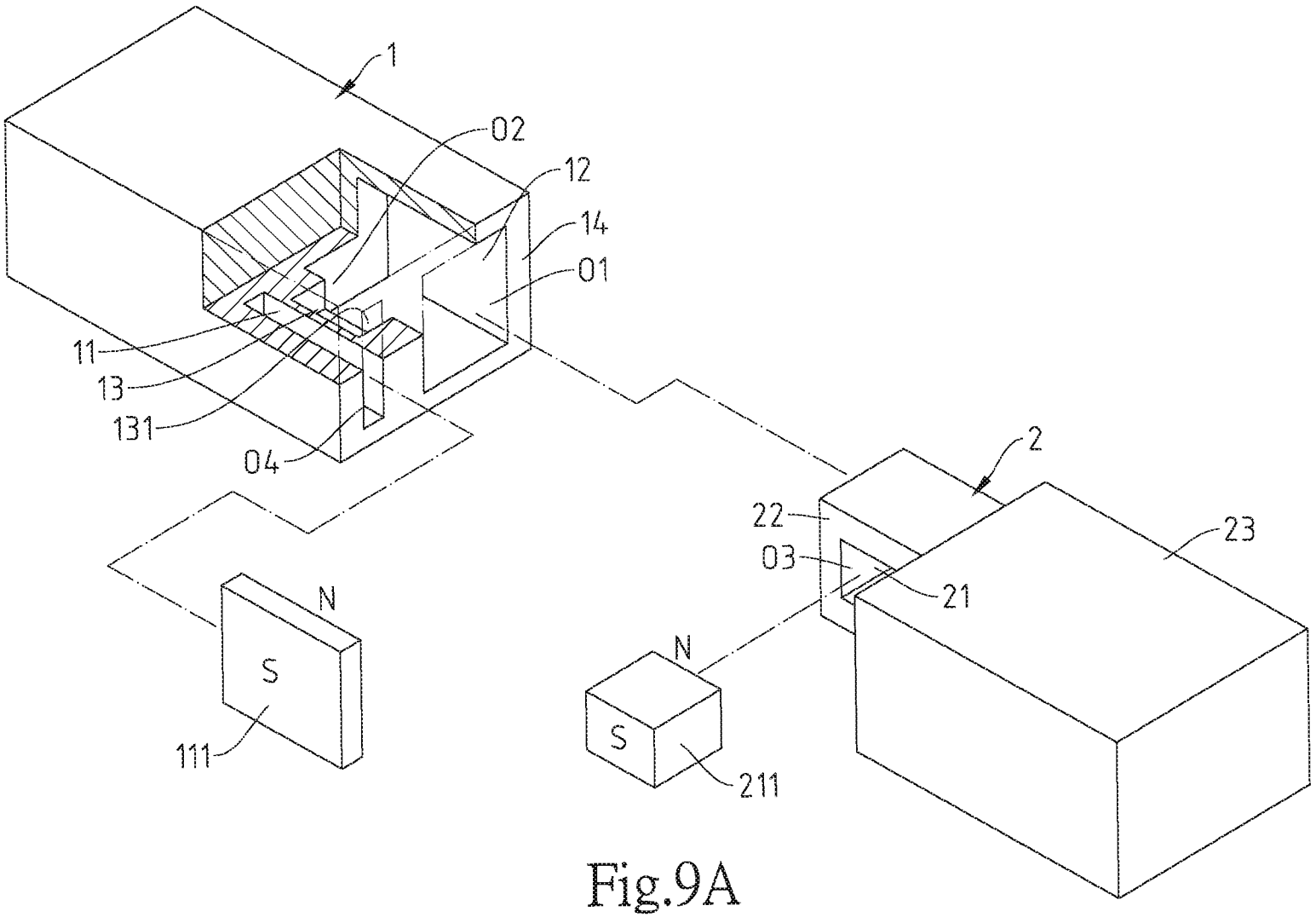
FIG. 9A is a three dimensional explosive diagram of a magnetic assembly structure provided by a third embodiment of the present disclosure.
Figure 9B:
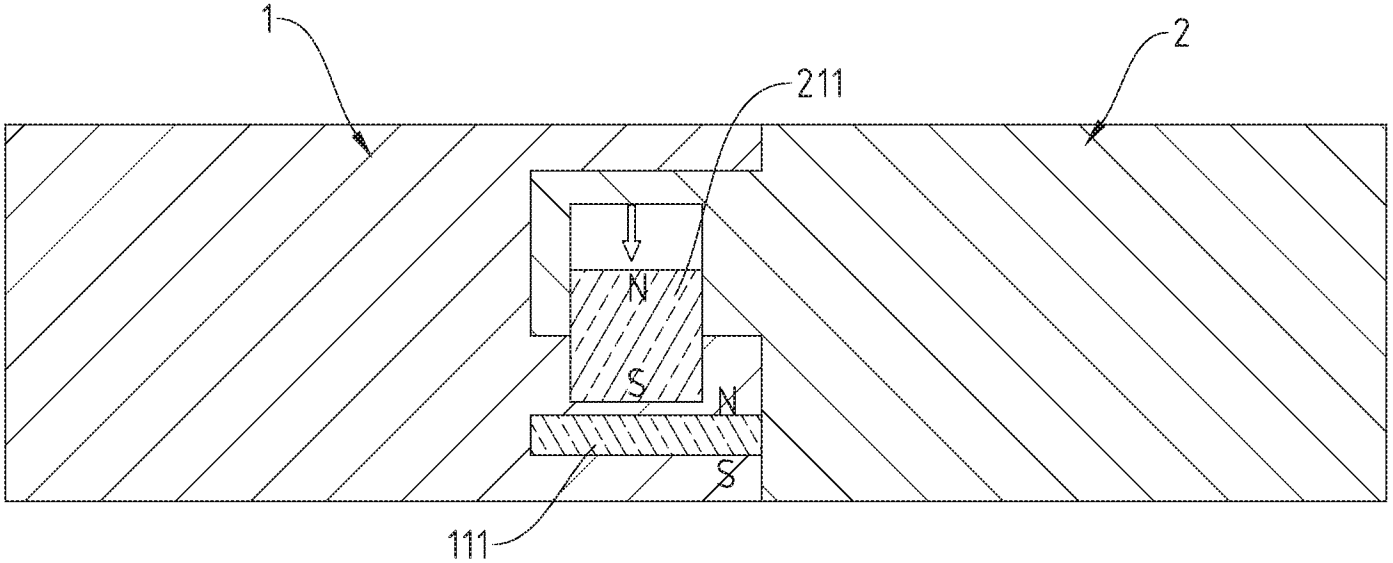
FIG. 9B is a top view of an assembled magnetic assembly structure provided by a third embodiment of the present disclosure.
Figure 9C:
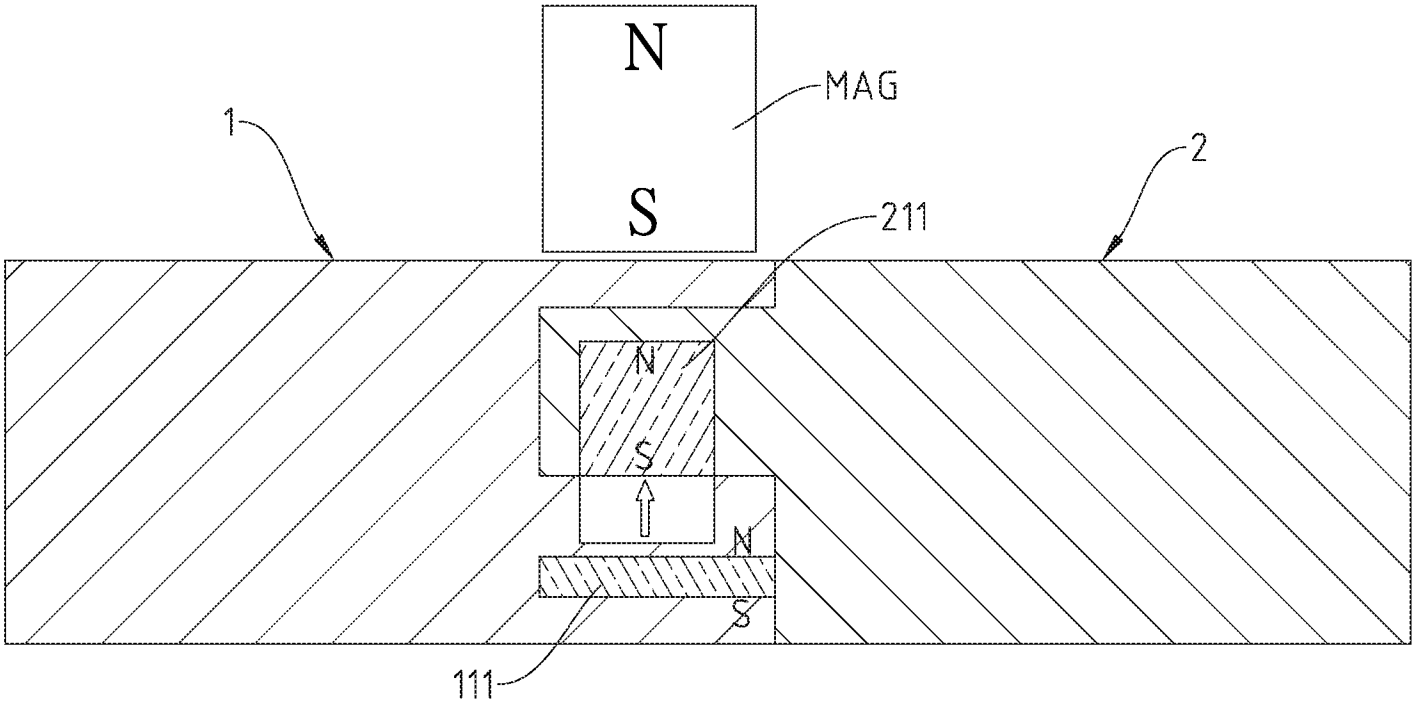
FIG. 9C is a top view of disassembling an assembled magnetic assembly structure provided by a third embodiment of the present disclosure.

FIG. 9A through FIG. 9C are used to illustrate a whole structure and an assembling/disassembling manner of a magnetic assembly structure provided by a third embodiment of the present disclosure. As shown in FIG. 9A through FIG. 9C, the differences between the third embodiment and the second embodiment are the types of the first magnetic components 111 in the two different embodiments. In the third embodiment, the first magnetic component 111 is a magnet component and the two opposite magnet poles of the first magnetic component 111 and second magnetic component 211 (i.e. the magnet poles of the first magnetic component 111 and second magnetic component 211, which face to each other) are different. For example, the N pole of the first magnetic component 111 faces the S pole of the second magnetic component 211. In addition, from the illustration of the third embodiment, the person with the ordinary skill in the art can replaces the first magnetic component 111 in the first embodiment by a magnet component.

The assembling manner of the magnetic assembly structure of the third embodiment is the same as that of the magnetic assembly structure in the second embodiment, and thus the redundant descriptions are omitted. The disassembling manner of the magnetic assembly structure of the third embodiment is illustrated as follows. As shown FIG. 9A and FIG. 9C (refer to FIG. 9C mainly, and refer to FIG. 9A secondarily), when disassembling, a magnetic attracting force of a provided external magnetic component MAG and the second magnetic component 211 (i.e. the S pole of the external magnetic component MAG faces the N pole of the second magnetic component 211) is utilized to make the portion of the second magnetic component 211, which is located in the engagement slot 13, move into the second receiving slot 12. Next, the user can take the inserting component 2 out from the second receiving slot 12 via the main body opening O1, so as to complete the disassembly.

Figure 10A:
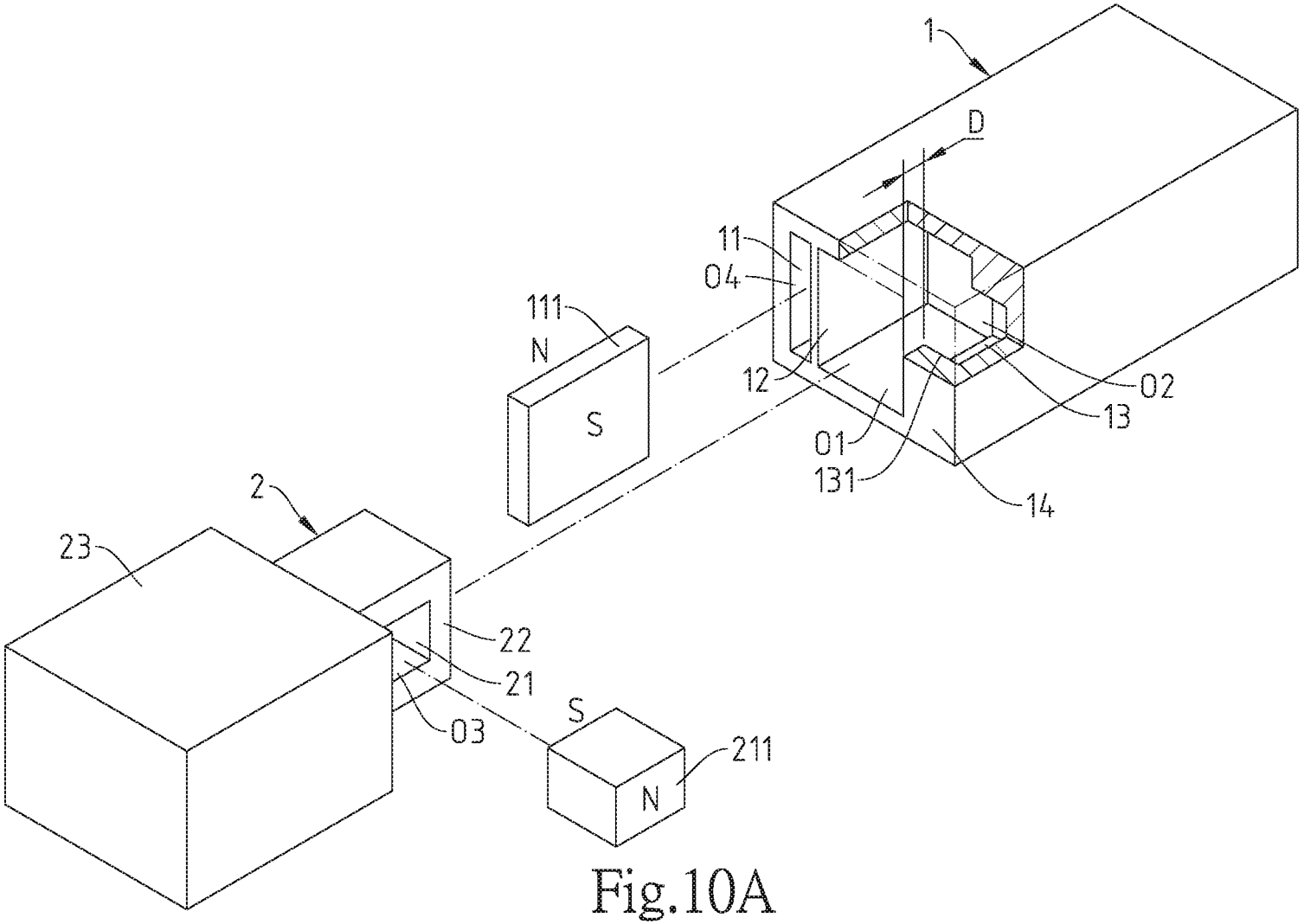
FIG. 10A is a three dimensional explosive diagram of a magnetic assembly structure provided by a fourth embodiment of the present disclosure.
Figure 10B:
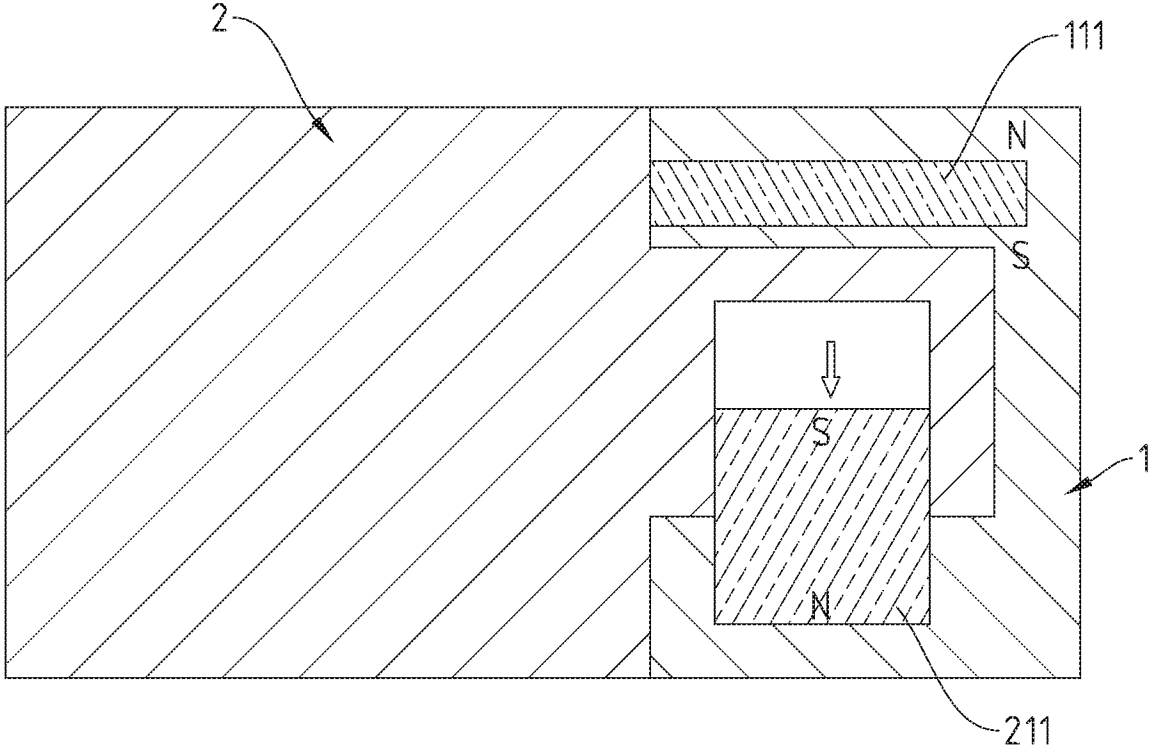
FIG. 10B is a top view of an assembled magnetic assembly structure provided by a fourth embodiment of the present disclosure.
Figure 10C:
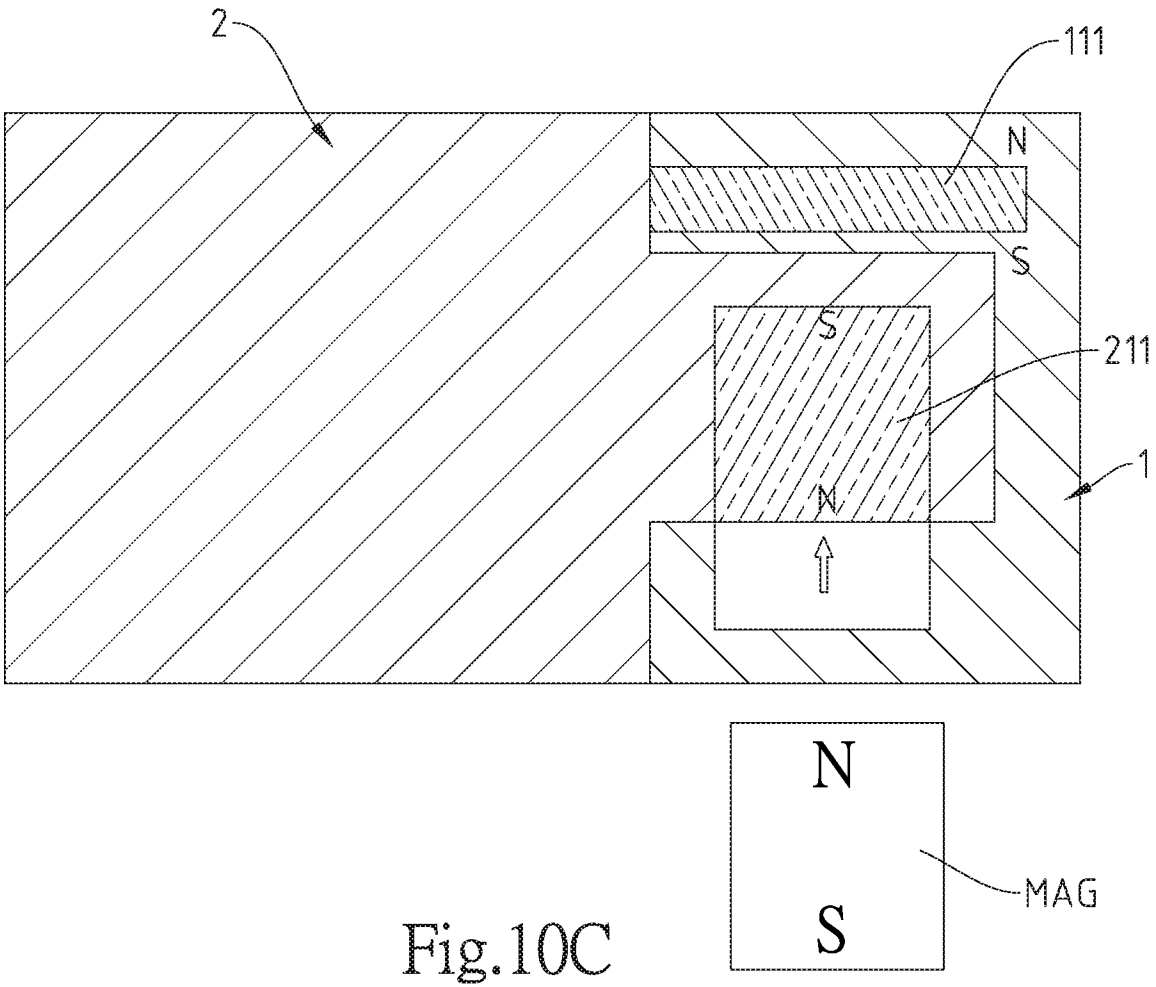
FIG. 10C is a top view of disassembling an assembled magnetic assembly structure provided by a fourth embodiment of the present disclosure.

FIG. 10A through FIG. 10C are used to illustrate a whole structure and an assembling/disassembling manner of a magnetic assembly structure provided by a fourth embodiment of the present disclosure. As shown in FIG. 10A through FIG. 10C, the differences between the fourth embodiment and the third embodiment are allocations of the engagement slots 13 in the two different embodiments. In the fourth embodiment, the second receiving slot 12 is disposed between the first receiving slot 11 and the engagement slot 13, and when assembling, the magnetic repulsive force of the second magnetic component 211 and the first magnetic component 111 makes the second magnetic component 211 move into the engagement slot 13 (as shown in FIG. 10B). The first magnetic component 111 and the second magnetic component 211 are two magnet components, and two opposite magnet poles of the first magnetic component 111 and the second magnetic component 211 are identical, for example, S poles. Additionally, when disassembling, a magnetic repulsive force of a provided external magnetic component MAG and the second magnetic component 211 is utilized to make the portion of the second magnetic component 211, which is located in the engagement slot 13, move into the second receiving slot 12 (see FIG. 10C). Next, the user can take the inserting component 2 out from the second receiving slot 12 via the main body opening O1, so as to complete the disassembly.

Figure 11A:
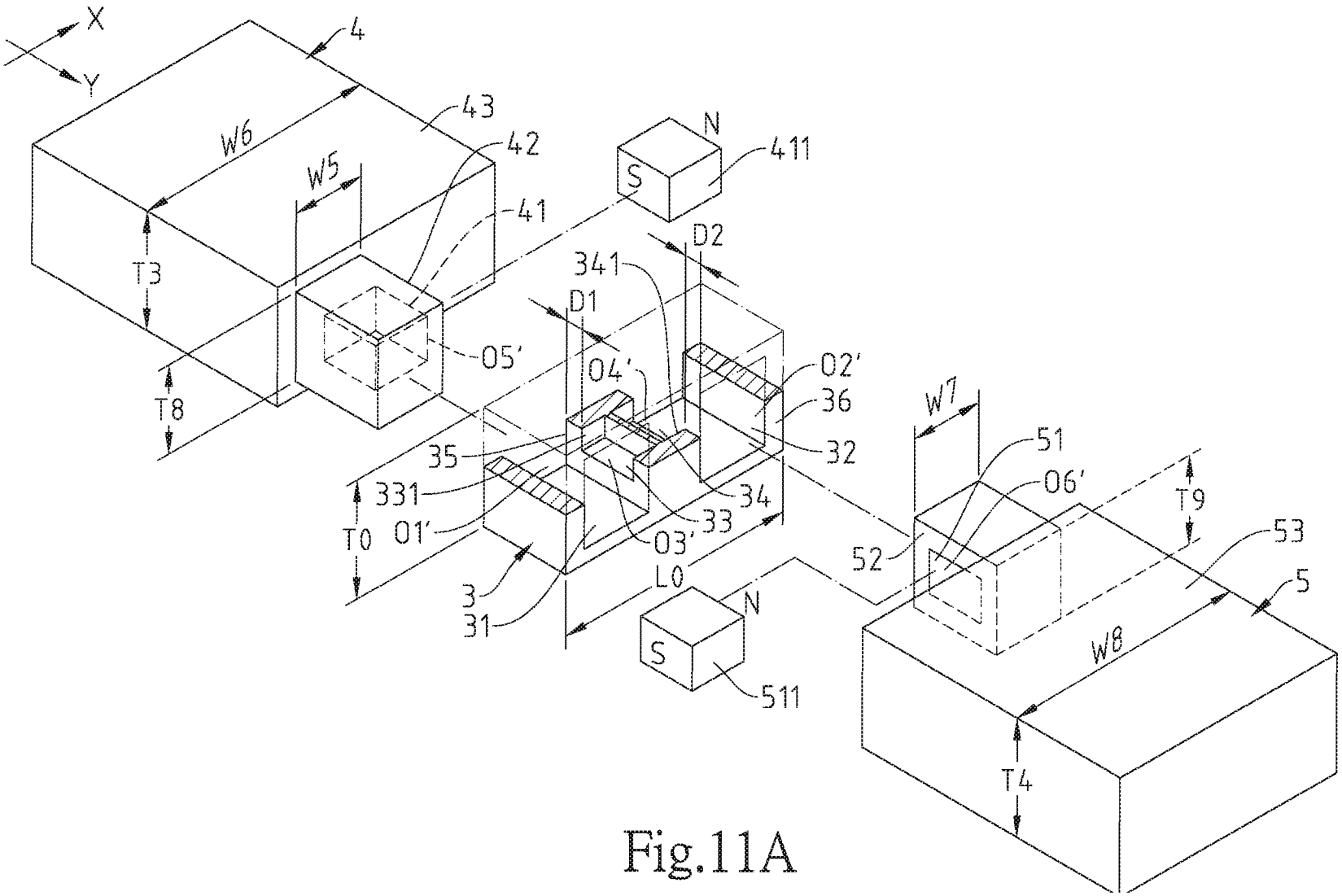
FIG. 11A is a three dimensional explosive diagram of a magnetic assembly structure provided by a fifth embodiment of the present disclosure.
Figure 11B:
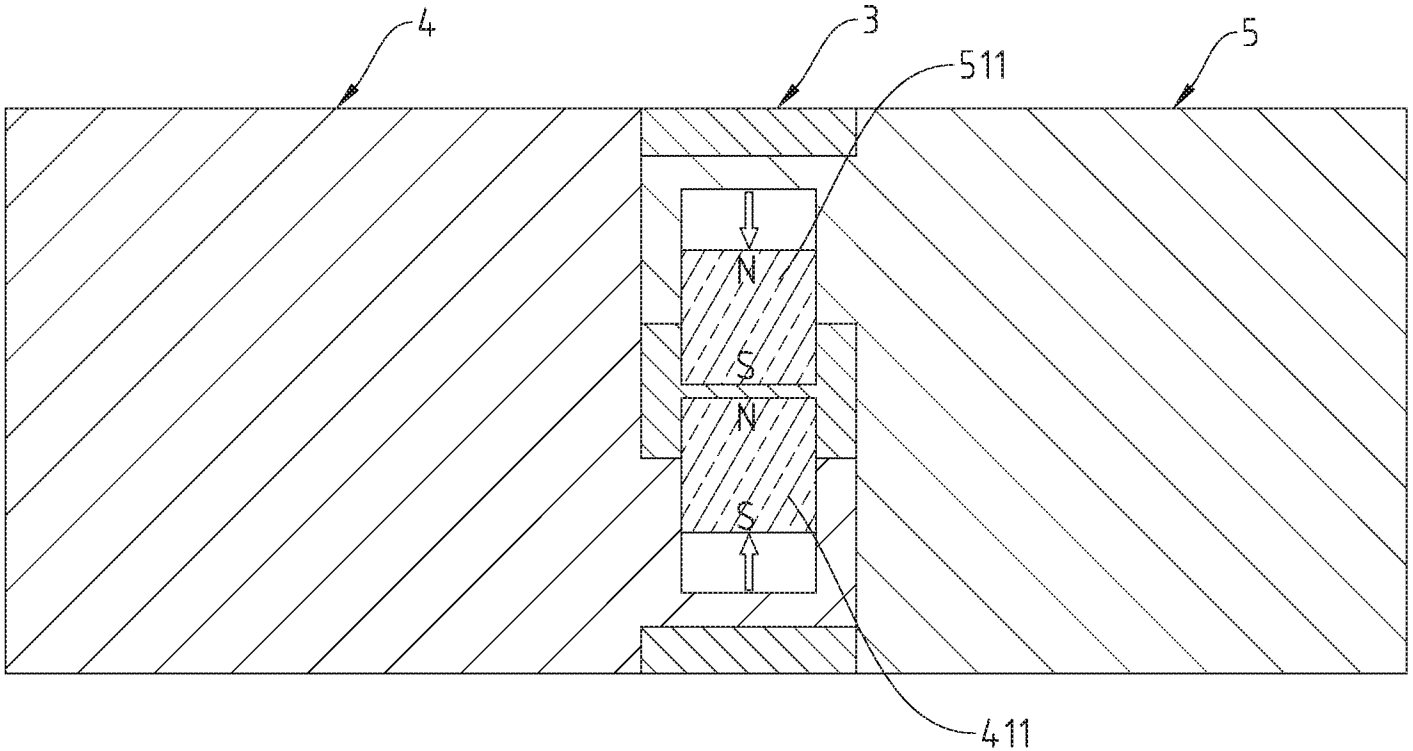
FIG. 11B is a top view of an assembled magnetic assembly structure provided by a fifth embodiment of the present disclosure.
Figure 11C:
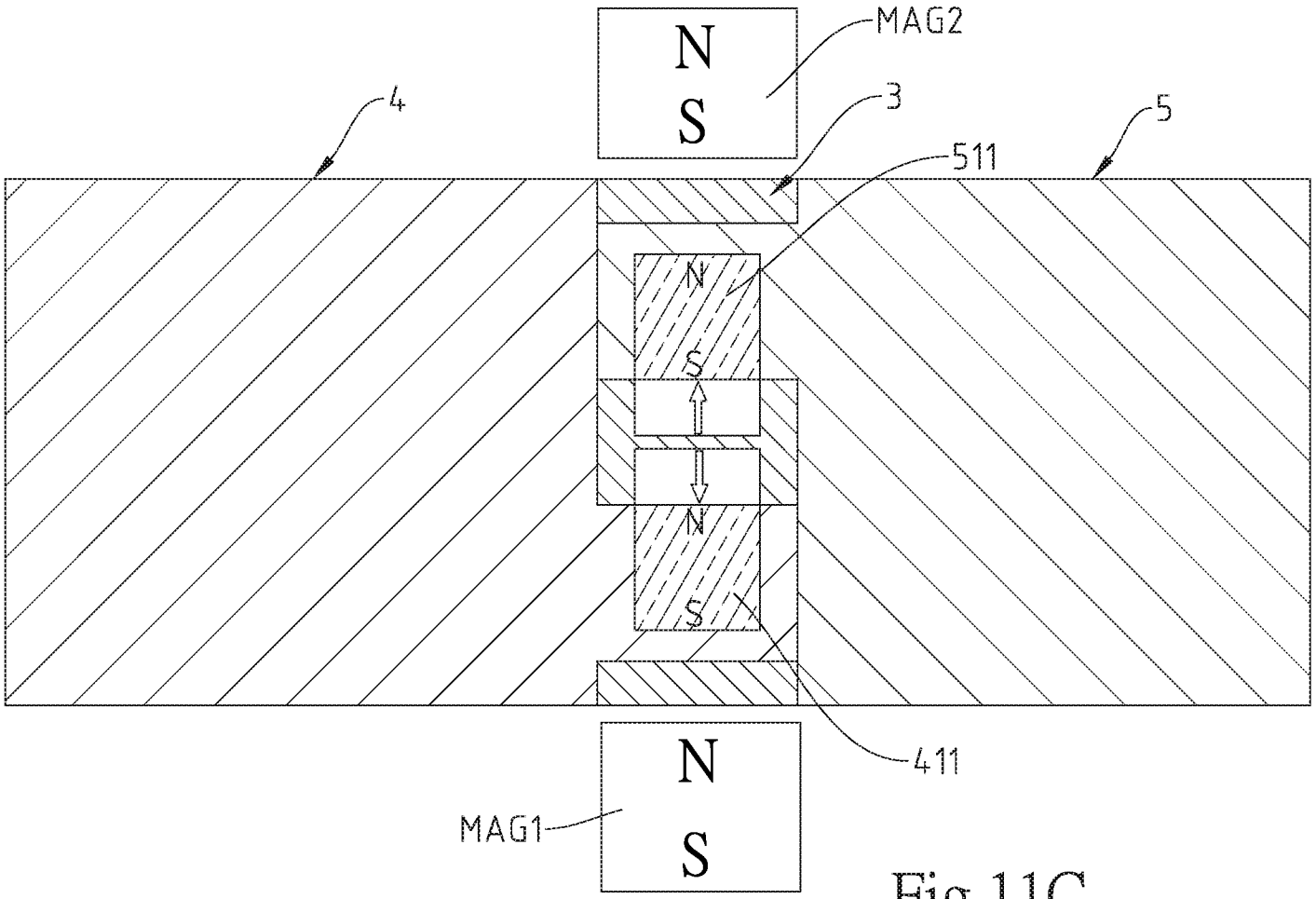
FIG. 11C is a top view of disassembling an assembled magnetic assembly structure provided by a fifth embodiment of the present disclosure.

FIG. 11A through FIG. 11C are used to illustrate a whole structure and an assembling/disassembling manner of a magnetic assembly structure provided by a fifth embodiment of the present disclosure. The differences between the magnetic assembly structure in the fifth embodiment and the magnetic assembly structure in the first through second embodiments are that the magnetic assembly structure comprises a plurality of inserting components, and the main body does not comprises the magnetic component. Referring to FIG. 11A, the magnetic assembly structure comprises a main body 3, a first inserting component 4 and a second inserting component 5. The main body 3 extends along a first direction X, the first inserting component 4 and the second inserting component 5 extend along the second direction Y being vertical to the first direction X. The two back ends of the first inserting component 4 and the second inserting component 5 are respectively the first bulk portion 43 and the second bulk portion 53. The widths W5, W7 and the thicknesses T8, T9 of the two front ends of the first inserting component 4 and the second inserting component 5 are respectively less than the widths W6, W8 and the thicknesses T3, T4 of the two back ends of the first inserting component 4 and the second inserting component 5, and the widths W6, W8 and the thicknesses T3, T4 of the two back ends of the first inserting component 4 and the second inserting component 5 are equal to the length L0 and the thickness T0 of the main body 3.

In other words, section areas of the first bulk portion 43 and the second bulk portion 53 of the first inserting component 4 and the second inserting component 5, which face the second direction Y, are equal to the section area of the main body, which faces the second direction Y. Thus, the assembled magnetic assembly structure is almost one part, the joint surface is almost flat, and merely tiny thin line between the main body 3, the first inserting component 4 and the second inserting component 5 can be seen. In the fifth embodiment, the magnetic assembly structure can also be applied in the furniture, daily necessity and electronic equipment, and the present disclosure is not limited thereto, thus having a wide application scope. For example, the main body 3 can be a table intermediate part, the first inserting component 4 can be the main table leg body, and the second inserting component 5 can be the extension table leg part, so as to form a longer table leg. Since the assembled magnetic assembly structure has the almost flat joint surface, being not like the conventional assembly structure, the assembled magnetic assembly structure has no non-flat joint surfaces which may be hook by the user to cause the damage or danger, and the magnetic assembly structure in the fifth embodiment has the higher safety.

The main body 3 has a first receiving slot 31, a second receiving slot 32, a first engagement slot 33, a second engagement slot 34, a first main body surface 35 and a second main body surface 36, wherein the first main body surface 35 is disposed corresponding to the second main body surface 36. The first receiving slot 31 penetrates the first main body surface 35 to form a first main body openingOl' on the first main body surface 35, and the second receiving slot 32 penetrates the second main body surface 36 to form a second main body opening O2' on the second main body surface 36. The first engagement slot 33 and the second engagement slot 34 are respectively communicated with the first receiving slot 31 and the second receiving slot 32 via the first communicating opening O3' and the second communicating opening O4', and respectively have a first contacting surface 331 and a second contacting surface 341, which are respectively away from the first main body surface 35 and the second main body surface 36 with a first distance D1 and a second distance D2. The first engagement slot 33 and the second engagement slot 34 are disposed between the first receiving slot 31 and the second receiving slot 32.

The first inserting component 4 has a first receiving slot of the first inserting component 41 and a first inserting component surface 42, the first receiving slot of the first inserting component 41 penetrates the first inserting component surface 42 to form a first inserting component opening O5' on the first inserting component surface 42, and the first magnetic component 411 is disposed in the first receiving slot of the first inserting component 41 via the first inserting component opening O5'. The second inserting component 5 has a second receiving slot of the second inserting component 51 and a second inserting component surface 52, the second receiving slot of the second inserting component 51 penetrates the second inserting component surface 52 to form a second inserting component opening O6' on the second inserting component surface 52, and the second magnetic component 511 is disposed in the second receiving slot of the second inserting component 51 via the second inserting component opening O6'. The first magnetic component 411 and the second magnetic component 511 are magnet components, and two opposite magnet poles of the first magnetic component 411 and the second magnetic component 511 are respectively an N pole and an S pole.

As shown FIG. 11A and FIG. 11B (refer to FIG. 11B mainly, and refer to FIG. 11A secondarily), when assembling, the first inserting component 4 and the second inserting component 5 are respectively into the first receiving slot 31 and the second receiving slot 32 via the first main body opening O1' and the second main body opening O2'. Specifically, the section area of the first main body opening O1' can be larger than or equal to the section area of first inserting component 4, which faces the first main body opening O1', such that the first inserting component 4 can be inserted into the first receiving slot 31 via the first main body opening O1'; the section area of the second main body opening O2' can be larger than or equal to the section area of second inserting component 5, which faces the second main body opening O2', such that the second inserting component 5 can be inserted into the second receiving slot 32 via the second main body opening O2'.

After the user inserts the first inserting component 4 and the second inserting component 5 into the first receiving slot 31 and the second receiving slot 32, via a magnetic attracting force induced by the first magnetic component 411 and the second magnetic component 511, the first magnetic component 411 sequentially passes the first inserting component opening O5' and the first communicating opening O3' to move into the first engagement slot 33, and via a magnetic attracting force induced by the first magnetic component 411 and the second magnetic component 511, the second magnetic component 511 sequentially passes the second inserting component opening O6' and the second communicating opening O4' to move into the second engagement slot 34, wherein portions of the first magnetic component 411 and the second magnetic component 511 respectively move into the first engagement slot 33 and the second engagement slot 34, and other portions of the first magnetic component 411 and the second magnetic component 511 respectively stay in the first receiving slot 31 and the second receiving slot 32. The first magnetic component 411 and the second magnetic component 511 respectively contact the first contacting surface 331 and the second contacting surface 341, so as to prevent the first inserting component 4 and the second inserting component 5 from respectively sliding out from the first receiving slot 31 and the second receiving slot 32. Specifically, the section area of the first communicating opening O3' can be larger than or equal to the section area of the first inserting component opening O5', such that the first magnetic component 411 can move into the first engagement slot 31; and the section are of the second communicating opening O4' can be larger than or equal to the section area of the second inserting component opening O6', such that the second magnetic component 511 can move into the second engagement slot 32. Since the first magnetic component 411 and the second magnetic component 511 move into the first engagement slot 33 and the second engagement slot 34 due to the magnetic force, the fixing and screwing manners are not required, and the magnetic assembly structure has an advantage of assembling with a less force.

As shown FIG. 11A and FIG. 11C (refer to FIG. 11C mainly, and refer to FIG. 11A secondarily), when disassembling, a magnetic attracting force of a provided first external magnetic component MAGI and the first magnetic component 411 (i.e. the N pole of the first external magnetic component MAGI faces the S pole of the first magnetic component 411) is utilized to make the portion of the first magnetic component 411, which is located in the first engagement slot 33, move to the first receiving slot 31, and a magnetic attracting force of a provided second external magnetic component MAG2 and the second magnetic component 511 (i.e. the S pole of the second external magnetic component MAG2 faces the N pole of the second magnetic component 511) is utilized to make the portion of the second magnetic component 511, which is located in the second engagement slot 34, move to the second receiving slot 32. Next, the first inserting component 4 and the second inserting component 5 are taken out from the first receiving slot 31 and the second receiving slot 32 via the first main body opening O1' and the second main body opening O2', so as to complete the disassembly.

Additionally, allocations of the first receiving slot 31, the second receiving slot 32, the first engagement slot 33 and the second engagement slot 34 in the fifth embodiment can be changed to be that the first receiving slot 31 and the second receiving slot 32 are disposed between the first engagement slot 33 and the second engagement slot 34, and meanwhile, the first magnetic component 411 and the second magnetic component 511 are two magnet components and two opposite magnet poles of the first magnetic component 411 and the second magnetic component 511 are identical, for example, N poles. Thus, when assembling, a magnetic repulsive force of the first magnetic component 411 and the second magnetic component 511 can make the first magnetic component 411 and the second magnetic component 511 respectively move into the first engagement slot 33 and the second engagement slot 34. When disassembling, magnetic repulsive forces provided by the first external magnetic component MAGI and the second external magnetic component MAG2 are utilized to make the portions of the first magnetic component 411 and the second magnetic component 511, which are respectively located in the first engagement slot 33 and the second engagement slot 34, move to the first engagement slot 31 and the second receiving slot 32.

According to the descriptions of the embodiments, compared to the prior art, the magnetic assembly structure of the present disclosure utilizes the magnetic force of the magnetic components to assemble the main body and the inserting component, and thus the assembling force is decreased to have the advantage of assembling with a less force. Further, the malicious person cannot see the assembling manner from the appearance of the magnetic assembly structure, and the magnetic assembly structure can simultaneously resist against the vertical and rotational disassembling manners. Therefore, without allowance or explanations, the malicious person cannot disassemble the magnetic assembly structure. Moreover, the joint surface of the magnetic assembly structure is flat, thus it can prevent the user from being hook by the joint surface to avoid damage and danger, and the safety is increased.

To sum up, the magnetic assembly structures in the embodiments are illustrated as the above, and can achieve the predicated technical results. The present disclosure is not anticipated by the prior art known by the inventors, and the inventors believe the present disclosure meets the specifications associated with the provisions of the patent law. Thus, the inventors submit the application of the present disclosure to respectfully request a substantial examination for obtaining the patent right.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A magnetic assembly structure, comprising:

a main body, having a first receiving slot, a second receiving slot, an engagement slot and a main body surface, wherein the first receiving slot receives a first magnetic component, the second receiving slot penetrates the main body surface to form a main body opening on the main body surface, the engagement slot is disposed between the first receiving slot and the second receiving slot, or alternatively, the second receiving slot is disposed between the first receiving slot and the engagement slot, and the engagement slot is communicated with the second receiving slot and has a contacting surface which is away from the main body surface with a distance; and an inserting component, having a receiving slot of the inserting component, and the receiving slot of the inserting component receives a second magnetic component;

wherein the inserting component is inserted into the second receiving slot via the main body opening, and the second magnetic component moves into the engagement slot.

2. The magnetic assembly structure according to claim 1, wherein a portion of the second magnetic component moves into the engagement slot, and other portion of the second magnetic component stays in the second receiving slot, so as to prevent the inserting component from sliding out from the second receiving slot.

3. The magnetic assembly structure according to claim 2, wherein the second magnetic component contacts the contacting surface, so as to prevent the inserting component from sliding out from the second receiving slot.

4. The magnetic assembly structure according to claim 1, wherein the engagement slot is disposed between the first receiving slot and the second receiving slot, and the second magnetic component moves into the engagement slot via a magnetic attracting force induced by the second magnetic component and first magnetic component.

5. The magnetic assembly structure according to claim 4, wherein the first magnetic component is a magnetic conduction component and the second magnetic component is a magnet component, or the first magnetic component and the second magnetic component are two magnet components and two opposite magnet poles of the first magnetic component and the second magnetic component are different.

6. The magnetic assembly structure according to claim 1, wherein the second receiving slot is disposed between the first receiving slot and the engagement slot, and the second magnetic component moves into the engagement slot via a magnetic repulsive force induced by the second magnetic component and first magnetic component.

7. The magnetic assembly structure according to claim 6, wherein the first magnetic component and the second magnetic component are two magnet components and two opposite magnet poles of the first magnetic component and the second magnetic component are identical.

8. The magnetic assembly structure according to claim 1, wherein the engagement slot is communicated with the second receiving slot via a communicating opening, and the second magnetic component moves into the engagement slot via the communicating opening.

9. The magnetic assembly structure according to claim 8, wherein the inserting component has an inserting component surface, the receiving slot of the inserting component penetrates the inserting component surface to form an inserting component opening on the inserting component surface, and the second magnetic component sequentially passes the inserting component opening and the communicating opening to move into the engagement slot.

10. The magnetic assembly structure according to claim 1, wherein the first receiving slot penetrates the main body surface to form a first receiving slot opening on the main body surface, and the first magnetic component is disposed in the first receiving slot via the first receiving slot opening.

11. A assembling/disassembling method using the magnetic assembly structure of claim 1, comprising:

when assembling: inserting the inserting component into the second receiving slot via the main body opening; and when disassembling: providing an external magnetic component and utilizing a magnetic force of the external magnetic component and the second magnetic component to move a portion of the second magnetic component, which is located in the engagement slot, to the second receiving slot from the engagement slot, and next, taking the inserting component out from the second receiving slot via the main body opening.

* * * * *